US005256254A

United States Patent [19]

Pease et al.

[11] Patent Number: 5,256,254

[45] Date of Patent: * Oct. 26, 1993

[54] METHODS OF CONTROLLING DEPOSITION IN A PAPER MACHINE DRYER SECTION

[75] Inventors: Jacqueline K. Pease; Dennis W. Barton; Glenn J. Henderson, all of Jacksonville, Fla.

[73] Assignee: Betz PaperChem, Inc., Jacksonville, Fla.

[ * ] Notice: The portion of the term of this patent subsequent to Dec. 1, 2009 has been disclaimed.

[21] Appl. No.: 729,524

[22] Filed: Jul. 12, 1991

[51] Int. Cl.[5] ..... D21F 1/32

[52] U.S. Cl. ..... 162/199; 162/DIG. 4; 162/164.7

[58] Field of Search ..... 162/199, DIG. 4, 164.7, 162/135, 158; 427/162, 395

[56] References Cited

U.S. PATENT DOCUMENTS 3,692,885 9/1972 Anello ..... 162/158
4,686,119 8/1987 Nojima et al. ..... 427/362
4,698,133 10/1987 Moreland ..... 162/5
4,781,794 11/1988 Moreland ..... 162/199
4,857,126 8/1989 Soremark et al. ..... 156/205
4,871,424 10/1989 Dreisbach et al. ..... 162/168.1
4,886,575 12/1989 Moreland ..... 162/5

FOREIGN PATENT DOCUMENTS 57-176285 3/1982 Japan ..... 162/4

*Primary Examiner*—W. Gary Jones
*Assistant Examiner*—Brenda Lamb
*Attorney, Agent, or Firm*—Alexander D. Ricci; Steven D. Boyd

[57] ABSTRACT

The present invention is directed to the use of phosphate esters or taurines to inhibit dryer section deposition in a pulp making or paper machine when the pulp furnish used contains tacky materials. The deposition control agent may be added to the pulp furnish or sprayed on the paper web. The phosphate ester may be a mono-, di- or triester.

3 Claims, No Drawings

METHODS OF CONTROLLING DEPOSITION IN A PAPER MACHINE DRYER SECTION

FIELD OF THE INVENTION

The present invention relates to decreasing deposition in a paper making process. More particularly, the present invention relates to decreasing deposition of undesirable materials in the dryer section of a paper machine through application of a phosphate ester or a taurine. The phosphate ester or taurine may be added to the papermaking stock furnish, to the surface of the paper web via an aqueous spray, or to surfaces such as cans and rollers via a spray or a puddle application.

BACKGROUND OF THE INVENTION

Deposition of undesirable materials can be detrimental to the efficient operation of paper or pulp mills. Deposition problems in the dryer section of a paper or pulp mill result when paper, paperboard, or market pulp is made from a pulp furnish which contain materials that, due to their hydrophobic nature, have a tendency to be tacky at the dry end of the paper machine. These tacky materials may be picked out of the paper web due to adherence directly to the dryer cans. In a similar dry environment, these materials may be picked out of certain press rolls. Aggregates of these materials can also be transferred from the press section to the sheets and be redeposited in the dryer section. Deposits in a paper machine dryer section may occur on the dryer can surfaces as well as the dryer fabrics and the dryer fabric carrier rolls. Dryer section deposits can be costly as they cause sheet defects such as holes, spots and coating streaks. The deposits can also cause lost production time due to the need for excessive equipment and dryer fabric cleanup. In severe cases, the costly dryer fabrics will need to be replaced prematurely. Current treatments for dryer deposit control have met with limited success.

Materials which may be tacky in the dry end of a paper machine can include processing aids such as antifoams and sizing agents, natural resins such as wood pitch, as well as materials added to paper to improve its function (coatings, glues, etc.) which end up in the paper making process when these papers are reused. Deposits which occur when papers are reused are commonly referred to as white pitch and stickies. The problem of white pitch deposition occurs when coated paper is reused. Coatings generally comprise (1) latex, generally styrene butadiene (SBR) and/or polyvinyl acetate (PVAC), (2) binders such as starch, casein, polyvinyl alcohol, etc., and (3) inorganic pigments, usually clay, calcium carbonate and titanium dioxide.

The problem of stickies deposition occurs when paper or paperboards are recycled which contain materials such as (1) labels and envelopes with adhesives such as SBR and vinyl acrylates, (2) books and magazine bindings containing hot melt glues such as vinyl acetate polymers, and (3) produce boxes with wax or polyethylene coatings or (4) materials which contain packing tape. Dryer section deposition occurring from these sources may or may not also contain natural wood pitch components such as fatty esters and fatty acids or sizing agents such as rosin, alkenylsuccinic anhydride, or alkyl ketene dimer.

Various methods of controlling deposits in papermaking systems are known. U.S. Pat. No. 4,886,575, December 1989 to Moreland discloses the use of certain types of polyvinyl alcohol for detackification of adhesive materials in secondary fiber. U.S. Pat. No. 4,871,424, October 1989 to Driesbach et al., teaches the use of certain types of polyvinyl alcohol for controlling natural wood pitch deposition. In both cases, detackification of the specific tacky material was for deposition control on all equipment surfaces throughout the papermaking environment.

U.S. Pat. Nos. 4,698,133 October 1987 and 4,781,794 November 1988 to Moreland teach the use of a methyl ether cellulose derivatives for detackification of adhesive material in secondary fiber to decrease deposits in a papermaking environment.

U.S. Pat. No. 4,686,119, August 1987 to Nojima et al., teaches a method of producing cast coated paper wherein a releasing agent is included in the coating formulation in order to decrease the sticking of the coating to the drum of the cast coater. The release agents were selected from the group of a phosphates having a fatty hydrocarbon radical with 6 to 20 carbon atoms, and amine salts thereof and lecithin which includes synthetic phosphatidyl chlorine derivatives. U.S. Pat. No. 4,857,126 August 1989 to Soremark et al., teaches a process for improving the release of wet coated paper from coating rolls to improve the appearance of the coated surface. The method utilizes a release agent comprising equal molar amounts of an alkanolamine and a fatty acid. The release agent is added directly to the coating formulation.

SUMMARY OF THE INVENTION

The present invention provides a method for inhibiting dryer section deposition in a pulp making or paper machine when the pulp furnish contains tacky materials. As used herein, tacky materials refers to materials which are prone to deposit in dry or semi-dry environments such as wood pitch, recycled coating components, or adhesives. Such materials have a tendency to be tacky at the dry end of the paper machine. The properties of contact adhesion and agglomeration of the materials can cause problems in the dry section of a paper machine. The method of the present invention inhibits the deposition of these tacky materials in the dry section of a paper machine. The method comprises treating the system with a phosphate ester or a taurine. The phosphate ester may be a mono-, di-, or triester or mixture thereof.

The phosphate ester or taurine treatment can be added to the paper stock in the wet end of the pulp making or paper machine prior to forming the paper web or sprayed on the paper web prior to the dryer section of the paper machine. Phosphate esters with hydrophobes greater than 6 carbon atoms long and less than 50 moles of ethoxylation are the preferred class of treatment for decreasing dryer section deposition in accordance with the present invention.

DESCRIPTION OF THE PREFERRED EMBODIMENTS

The method of the present invention provides a phosphate ester or taurine to control the deposition of tacky materials in the dryer section of pulp making or papermaking machines. The mono-, di-, or triester phosphates or taurine may be added to the paper stock in the wet end, sprayed on the paper web prior to the dryer section, or sprayed or puddled directly on rolls which may contact the paper web. The tacky materials controlled by the present invention are those materials which have a tendency to be tacky at the dry end of the paper making process. These materials include sizing agents and some defoamers, wood pitch, white pitch and stickies. White pitch problems arise when coated paper is reused. Coatings are generally 1) latex, generally styrene butadiene (SBR) and/or polyvinyl acetate (PVAC), 2) binders such as starch, casein, polyvinyl alcohol, etc., and 3) inorganic pigments, usually clay, calcium carbonate, and titanium dioxide. Stickies are the result of paper or paperboard recycling where 1) labels and envelopes which contain adhesives such as SBR and vinyl acrylates, 2) books and magazine bindings containing hot melt glues such as vinyl acetate polymers, and 3) boxes with wax or polyethylene coating or packing tape are present.

The phosphate esters of the present invention are mono-, di-, or triesters of the general structure:

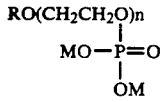

(monoester)

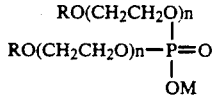

(diester)

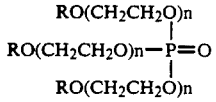

(triester)

where R is an alkyl or alkyl aryl radical, n is the number of moles of ethylene oxide and M is H or a counter ion such as $Na^+$, $K^+$ or $NH_3^+$.

The preferred phosphate esters are those with a hydrophobe (R) having greater than six carbon atoms and with less than 50 moles of ethoxylation (n less than 50). The phosphate esters tested in the following examples are anionic surfactants having mixtures of the above structures.

The taurines of the present invention have the general formula:

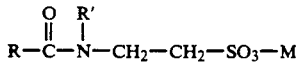

where R and R' are alkyl radicals and M is H or a counter ion such as $Na^+$, $K^+$ or $NH_3^+$.

The R and R' groups, for both phosphate esters and taurines may be alkyl or alkyl aryl group with the alkyl component having from 1-30 carbon atoms. The length of the groups is only limited by the water solubility or dispersability of the material. For the phosphate esters, the preferred R groups were those having more than 6 carbons and with less than 50 moles of ethoxylation. The R groups used in the following examples, for both phosphate esters and taurines, included the alkyl groups: methyl ($C_1$), hexyl ($C_6$), octyl ($C_8$), decyl ($C_{10}$), dodecyl ($C_{12}$), tridecyl ($C_{13}$), oleyl ($C_{18}$). Alkyl aryl group tested included: phenyl, nonylphenyl, and dinonyl phenyl.

These phosphate esters or taurine of the present invention may be added to the pulp at any stage of the papermaking system. The materials may be added in any manner though as a dilute aqueous solution is generally preferred for simplicity in handling and control. The effective amount of the phosphate esters or taurine to be added depends upon the severity of the deposit problem which often depends upon a number of variables including pH of the system hardness, temperature, and the makeup of the pulp. Generally, between 0.01 and 15 pounds of treatment per ton of fiber of the phosphate ester or taurine is added based upon the weight of dry pulp.

The invention will be further illustrated by the following examples which are included as illustrations of the invention and should not be construed as limiting the scope thereof.

EXAMPLES

The materials tested throughout the following examples are identified in Tables 1 through 6. Table 1 depicts the specific properties of the phosphate esters tested. Table 2 depicts the properties of other anionic surfactants, including taurines tested.

TABLE 1

Phosphate Ester Properties

| Identification | Hydrophobe (RO) | Moles EO (n) | Ester Ratio (mono/di/tri) |
|---|---|---|---|
| A1 | hexanol | 3.4 | 60/40/0 |
| A2 | octanol/decanol | 6 | 60/40/0 |
| A3 | dodecanol | 4 | 60/40/0 |
| A4 | tridecanol | 4 | 60/40/0 |
| A5 | oleyl alcohol | 4 | 60/40/0 |
| A6 | oleyl alcohol | 7 | 0/10/90 |
| A7 | phenol | 6 | 60/40/0 |
| A8 | phenol | 6 | 90/10/0 |
| A9 | nonylphenol | 4 | 60/40/0 |
| A10 | nonylphenol | 6 | 60/40/0 |
| A11 | nonylphenol | 9.5 | 60/40/0 |
| A12 | nonylphenol | 50 | 60/40/0 |
| A13 | nonylphenol, Na salt | 6 | 60/40/0 |
| A14 | dinonylphenol | 5 | 60/40/0 |
| A15 | dinonylphenol | 12 | 60/40/0 |

TABLE 2

Other Anionic Surfactants

| Identification | Description |
|---|---|
| B1 | sodium N-methyl-N-tall oil acid taurate |
| B2 | sodium N-methyl-N-oleoyltaurate |
| B3 | alkyl diphenyl oxide disulfonate |
| B4 | disodium alcohol ($C_{12}$) ethoxy (3 moles EO) sulfosuccinate |
| B5 | sulfated nonylphenol ethoxylate, sodium salt |
| B6 | ($C_{13}$) alcohol ethyoxy carboxylic acid, sodium salt |

TABLE 3

Anionic Polymers and Dispersants

| Identification | Description |
|---|---|
| D1 | sulfonated naphthalene-formaldehyde condensate, sodium salt |
| D2 | lignosulphonate, sodium salt |
| D3 | sulfonated kraft lignin, sodium salt |
| D4 | polyacrylic acid |
| D5 | sulfonated styrene maleic anhydride |
| D6 | hydroxyethylidene diphosphonic acid |
| D7 | hexamethylenediamine (methylene phosphonate), |

TABLE 3-continued

| Identification | Anionic Polymers and Dispersants Description |
|---|---|
| | potassium salt |

TABLE 4

| Identification | Nonionic Surfactants Description |
|---|---|
| E1 | polyoxyethylated (30 moles EO) castor oil |
| E2 | polyoxyethylated (4 moles EO) decyl alcohol |
| E3 | linear alcohol ($C_{12}$-$C_{15}$) ethoxylate (3 moles EO) |
| E4 | nonylphenol ethoxylate (4 moles EO) |
| E5 | nonylphenol ethoxylate (9 moles EO) |
| E6 | ethoxy propoxy ethoxy block copolymer (80% EO, low MW) |
| E7 | ethoxy propoxy ethoxy block copolymer (80% EO, high MW) |
| E8 | ethoxy propoxy ethoxy block copolymer (30% EO, high MW) |
| E9 | ethoxy propoxy ethoxy block copolymer (20% EO, low MW) |
| E10 | ethoxypolymethyl siloxane (high HLB, 1000 MW) |
| E11 | ethoxypolymethyl siloxane (low HLB, 3000 MW) |
| E12 | ethoxypolymethyl siloxane (high HLB, 4000 MW) |
| E13 | ethoxypolymethyl siloxane (low HLB, 600 MW) |

TABLE 5

| Identification | Hydrophilic Polymers Description |
|---|---|
| F1 | methyl hydroxypropyl cellulose (low MW) |
| F2 | methyl cellulose (high MW) |
| F3 | methyl hydroxypropyl cellulose (high MW) |
| F4 | methyl hydroxyethyl cellulose (low MW) |
| F5 | polyvinyl alcohol (87-89% hydrolyzed, high MW) |
| F6 | polyvinyl alcohol (87-89% hydrolyzed, low MW) |
| F7 | polyvinyl alcohol (73-77% hydrolyzed, low MW) |
| F8 | carboxy methylcellulose |

TABLE 6

| Identification | Cationic Surfactants and Miscellaneous Materials Description |
|---|---|
| G1 | polyoxyethylated (5 moles EO) tallow amine |
| G2 | cetyl trimethyl ammonium chloride |
| G3 | imidazoline |
| H1 | lecithin |

EXAMPLE 1

Internal Addition—White Pitch

Coated paper from a northern fine paper mill was pulped and blended (50/50) with a mixture of bleached pulp (70/30 hardwood/softwood pulp). Handsheets were made using a Noble and Wood sheet mold. Three hundred milliliters of blended stock (at 1% solids) were used to make the handsheets. The various treatments were added at 0.02 grams per liter of stock and allowed to mix for approximately 30 seconds prior to sheet formation. Foil was pressed to the wet handsheets with 20 psi pressure. The foil paper sheet was then dried on a drum dryer with the foil side adjacent to the dryer can surface. The handsheets were cut in strips and the peel strength necessary to remove the foil from the paper was measured using an Instron Tensile test apparatus. The peel strength is taken as an indication of the dryer section deposition potential. Therefore, a decrease in peel strength relates to a decrease in deposition tendency.

Phosphate esters were found to decrease the peel strength by a marked degree. The decrease in peel strength was accompanied by a decrease in the amount of material remaining on the foil surface. In the untreated system the foil was covered with a haze of white pigment from the coated broke as well as fines (small pieces of paper making fiber). With the addition of a phosphate ester the foil became relatively clean in appearance. The results achieved for phosphate esters added internally to the stock prior to sheet formation are contained in Table 7.

TABLE 7

Effect of Phosphate Esters on Peel Strength
Internal Addition - White Pitch

| Additive | Peel Strength (lbs/inch width) Average | Percent Decrease in Peel |
|---|---|---|
| Blank | 0.151 | — |
| A2 | 0.121 | 20 |
| A5 | 0.116 | 23 |
| A11 | 0.113 | 25 |
| A13 | 0.111 | 26 |

An unexpected decrease in sheet tackiness occurred with the addition of the phosphate esters to stock containing repulped coated paper. Based on two sample comparative statistics at 95% confidence the decreases were significant. The results achieved with other anionic surfactants are listed in Table 8. In each case, the phosphate esters outperformed the other anionic surfactants tested by a significant degree.

TABLE 8

Other Anionic Surfactants
Internal Application - White Pitch

| Additive | Peel Strength (lbs/inch width) Average | Percent Decrease in Peel |
|---|---|---|
| Blank | 0.151 | — |
| B1 | 0.140 | 7 |
| B3 | 0.145 | 4 |

Anionic dispersants and polymers were also tested (see Table 9). D3, a sulfonated Kraft lignin, and D5, a sulfonated styrene maleic anhydride copolymer performed on a par with the phosphate esters when added internally to the pulp furnish prior to sheet formation.

TABLE 9

Anionic Dispersants and Polymers
Internal Application - White Pitch

| Additive | Peel Strength (lbs/inch width) Average | Percent Decrease in Peel |
|---|---|---|
| Blank | 0.151 | — |
| D1 | 0.164 | −9 |
| D2 | 0.157 | −4 |
| D3 | 0.123 | 19 |
| D4 | 0.155 | −3 |
| D5 | 0.123 | 19 |

Nonionic and cationic surfactants were also tried on an internal basis. These materials did not provide significant reduction in sheet tack. See Table 10.

TABLE 10

| Nonionic and Cationic Surfactants Internal Application - White Pitch | | |
|---|---|---|
| Additive | Peel Strength (lbs/inch width) Average | Percent Decrease in Peel |
| Blank | 0.151 | — |
| E1 | 0.139 | 8 |
| E2 | 0.145 | 4 |
| E10 | 0.144 | 5 |
| E11 | 0.152 | −1 |
| E12 | 0.151 | 0 |
| E13 | 0.164 | −9 |
| G1 | 0.137 | 9 |

Table 11 contains the results for nonionic hydrophilic materials. Polyvinyl alcohol (F5, F6, and F7) performed on a par with the phosphate esters when added internally to the pulp furnish.

TABLE 11

| Nonionic Hydrophilic Materials Internal Application - White Pitch | | |
|---|---|---|
| Additive | Peel Strength (lbs/inch width) Average | Percent Decrease in Peel |
| Blank | 0.151 | — |
| F1 | 0.138 | 9 |
| F2 | 0.162 | −7 |
| F3 | 0.175 | −16 |
| F4 | 0.141 | 7 |
| F5 | 0.122 | 19 |
| F6 | 0.125 | 17 |
| F7 | 0.124 | 18 |

EXAMPLE 2

Surface Application—White Pitch

A similar procedure to that used in Example 1 was carried out for this example. Coated paper from another northern paper mill was pulped and used to make handsheets (unlike example 1, no extra pulp was added). In this example the treatments were applied to the surface of the pressed handsheet by atomizing the additives and applying $2.5\times10^{-8}$ pounds treatment per square inch of sheet surface. Foil was then pressed to the sprayed sheet and the handsheet dried in the drum dryer. The strips were peeled in the same manner as in Example 1. The additive dosage was 10 times less for this method of application as compared to the internal application in Example 1.

TABLE 12

| Phosphate Esters Surface Application - White Pitch | | |
|---|---|---|
| Additive | Peel Strength (lbs/inch width) Average | Percent Decrease in Peel |
| Blank | 0.071 | — |
| A1 | 0.076 | −7 |
| A3 | 0.039 | 45 |
| A4 | 0.039 | 45 |
| A5 | 0.031 | 56 |
| A7 | 0.067 | 6 |
| A8 | 0.062 | 13 |
| A9 | 0.028 | 61 |
| A10 | 0.044 | 38 |
| A11 | 0.038 | 46 |
| A12 | 0.054 | 24 |
| A13 | 0.039 | 45 |
| A14 | 0.051 | 28 |
| A15 | 0.046 | 35 |

A much more profound decrease in peel strength was achieved in this example as compared to that of Example 1. The dosage, approximately 10 times less than in Example 1, demonstrates the advantage of surface treatment for this type of application.

Comparing the phosphate ester structures listed in Table 1 with the results in Table 12 it becomes apparent that the length of the hydrophobic end of the phosphate ester is important to its dry detackification ability. As the alcohol chain length increased from $C_6$ to $C_{18}$, identified as phosphate esters A1 and A5, the detackification performance was increased. This was also the case for the alkylaryl-based phosphate esters. The esters containing only a phenol group for their hydrophobic end (A7 and A8) were not as effective as the nonyl phenol phosphate esters.

The level of ethoxylation is also important to the ability of the phosphate esters to detackify the handsheets containing coating components. At very high levels of ethoxylation (50 moles) performance was again lost for phosphate ester A12.

TABLE 13

| Anionic Dispersant and Polymers Surface Application - White Pitch | | |
|---|---|---|
| Additive | Peel Strength (lbs/inch width) Average | Percent Decrease in Peel |
| Blank | 0.071 | — |
| D1 | 0.070 | 1 |
| D2 | 0.065 | 8 |
| D3 | 0.071 | 0 |
| D4 | 0.057 | 20 |
| D5 | 0.059 | 17 |
| D6 | 0.053 | 25 |

Other anionic materials were also tested and the results are contained in Table 13. The sulfonated Kraft lignin, identified as D3, had performed equally to the phosphate esters when added to the stock prior to sheet formation in Example 1. However, when sprayed on the sheet, it did not work. Apparently it decreased the peel strength previously by dispersing the coating components rather than detackifying them. There is a correlation between particle size and dryer section deposition. Apparently D3 worked in Example 1 by affecting this parameter and not the tackiness of the coating components.

TABLE 14

| Nonionic Surfactants Surface Application - White Pitch | | |
|---|---|---|
| Additive | Peel Strength (lbs/inch width) Average | Percent Decrease in Peel |
| Blank | 0.071 | — |
| E3 | 0.052 | 27 |
| E4 | 0.065 | 8 |
| E5 | 0.064 | 10 |
| E6 | 0.055 | 23 |
| E7 | 0.067 | 6 |
| E8 | 0.062 | 13 |
| E9 | 0.061 | 14 |
| E10 | 0.076 | −7 |
| E11 | 0.054 | 24 |
| E12 | 0.075 | −6 |
| E13 | 0.066 | 7 |

The results achieved for nonionic surfactants are listed in Table 14. Nonionic surfactants which make up the hydrophobic ends of the effective phosphate esters were tested. These materials were E3, an alcohol ($C_{12}$–$C_{15}$) ethoxylate with 3 moles ethoxylation, and E4 and E5, nonyl phenol ethoxylates with 4 and 9 moles of ethoxylation, respectively. None of these materials performed at the level of their respective phosphate esters. The block copolymers of ethylene oxide and propylene oxide (E6–E9) did not perform at a level with the phosphate esters nor did the siloxanes (E10–E13).

TABLE 15

| Hydrophilic Polymers Surface Application - White Pitch | | |
|---|---|---|
| Additive | Peel Strength (lb/inch width) Average | Percent Decrease in Peel |
| Blank | 0.071 | — |
| F1 | 0.073 | −3 |
| F3 | 0.071 | 0 |
| F5 | 0.077 | −8 |
| F6 | 0.073 | −3 |
| F8 | 0.058 | 18 |

The results achieved for hydrophilic polymers are contained in Table 15. None of these materials provided as much control as the phosphate esters. There is a marked difference in the behavior of polyvinyl alcohol (F5 and F6) in this example as compared to the previous example where the additives were mixed with the stock prior to sheet formation. In the previous example, polyvinyl alcohol (PVA) performed as well as the phosphate esters. As a spray application, the PVA was antagonistic, actually increasing the peel strength. A possible explanation for this phenomena is that the benefit observed from PVA in the previous example was caused by a decrease in aggregation of the coating components, similar in effect to that of the sulfonated Kraft lignin (D3).

EXAMPLE 3

Surface Application—Stickies

This example was conducted in the same manner as example two with the following exceptions. Unbleached Kraft pulp containing contact adhesives from packing tape was used for the pulp furnish. The handsheets were sprayed prior to pressing on the top side of the handsheet where the most stickies were present.

Table 16 contains the results for some phosphate esters and hydrophilic materials used to control stickies. In addition to the peel strength data, the number of visible stickies which remained on the foil after peeling is also included.

TABLE 16

| Phosphate Esters and Typical Stickies Treatments Surface Application - Stickies | | | | |
|---|---|---|---|---|
| Additive | Peel Strength (lbs/inch Width) Average | Percent Decrease In Peel | Number of Stickies Remaining on Foil Average | Percent Decrease In Number |
| Blank | 0.117 | — | 29 | — |
| A1 | 0.084 | 28% | 18 | 38% |
| A5 | 0.030 | 74 | 13 | 55 |
| A6 | 0.074 | 37 | 19 | 34 |
| A9 | 0.020 | 83 | 14 | 52 |
| A11 | 0.044 | 62 | 15 | 48 |
| A12 | 0.091 | 22 | 19 | 34 |
| F3 | 0.100 | 15 | 25 | 14 |
| F5 | 0.121 | −3 | 36 | −24 |

The results for the dryer section deposition potential of stickies correlates with the results for white pitch (Example 2). The phosphate esters with long hydrophobic ends and low levels of ethoxylation (A5, A9, and A11) outperformed the phosphate ester with a short hydrophobe (A1) and the phosphate ester with a high degree of ethoxylation (A12). Apparently, phosphate esters with high levels of triester (A6) are less effective than similar materials with higher levels of monoester (A5). This could be due to decreased packing ability of the large triester molecule. The peel strength results also correlated with the number of stickies that deposited on the aluminum foil. The cellulose derivative (F3) and the PVA (F5), which were taught in U.S. Pat. Nos. 4,698,133 and 4,886,575 for stickies control in a wet environment did not perform on a par with the phosphate esters.

TABLE 17

| Anionic Surfactants and Dispersants Surface Application - Stickies | | |
|---|---|---|
| Additive | Peel Strength (lbs/inch width) Average | Percent Decrease in Peel |
| Blank | 0.117 | — |
| B2 | 0.063 | 46 |
| B4 | 0.097 | 17 |
| B5 | 0.083 | 29 |
| B6 | 0.098 | 16 |
| D6 | 0.082 | 30 |
| D7 | 0.116 | 1 |

The anionic surfactants tested included sulfates, sulfonates, sulfosuccinates, and carboxylates with similar backbone materials as those of the effective phosphate esters. The results are contained in Table 17. These materials, though providing some effect, were not as effective as the phosphate esters with similar characteristics. Material B2, sodium N-methyl-N-oleoyl taurate, clearly outperformed the other anionic surfactants and the less preferred phosphate esters.

Cationic surfactants were also tested with the pulp system containing adhesive, see Table 18. These materials were not effective at reducing the deposition potential of the system.

TABLE 18

| Cationic Surfactants and Miscellaneous Materials Surface Application - Stickies | | |
|---|---|---|
| Additive | Peel Strength (lbs/inch width) Average | Percent Decrease in Peel |
| Blank | 0.117 | — |
| G1 | 0.120 | −3% |
| G2 | 0.108 | 8 |
| G3 | 0.109 | 7 |
| H1 | 0.092 | 21 |

Lecithin, taught by U.S. Pat. No. 4,686,119, provided a marginal level of decrease in the deposition potential. However, this material did not perform at the same level as the phosphate esters or the taurine.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

What is claimed is:

1. A method of inhibiting deposition and adherency of tacky materials from pulp in a pulpmaking or papermaking system comprising subjecting the pulp, in the form of a paper web to water sprays and showers, said water sprays or showers including a sufficient amount for purpose of a deposit control agent comprising a phosphate ester wherein said phosphate ester is a mono ester of the general structure

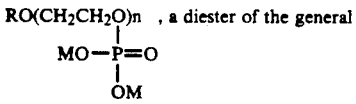

, a diester of the general structure

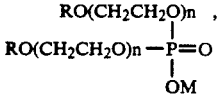

, or a triester

-continued of the general structure

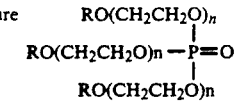

wherein R is an alkyl or alkyl aryl radical having up to about 30 carbons, n is less than about 50 and M is H, $Na^+$, $K^+$ or $NH_3^+$.

2. The method of claim 1 wherein R is selected from the group methyl, hexyl, octyl, decyl, dodecyl, tri decyl, oleyl, phenyl, nonyl phenyl and dinonyl phenyl.

3. The method of claim 1 wherein said deposit control agent is added to said water sprays or showers in an amount of from about 0.01 to 15 pounds of control agent per ton of fiber in the pulp.

* * * * *